US010216105B2

(12) United States Patent
Kaku et al.

(10) Patent No.: US 10,216,105 B2
(45) Date of Patent: Feb. 26, 2019

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Kenichi Kaku, Suntou-gun (JP); Takashi Anezaki, Hiratsuka (JP); Taichi Sato, Numazu (JP); Jumpei Kuno, Yokohama (JP); Atsushi Fujii, Yokohama (JP)

(73) Assignee: Canon Kabushiki Kaisa, Tokyo (JP)

( * ) Notice: Subject to any disclaimer, the term of this patent is extended or adjusted under 35 U.S.C. 154(b) by 0 days.

(21) Appl. No.: 15/903,802

(22) Filed: Feb. 23, 2018

(65) Prior Publication Data

US 2018/0246427 A1 Aug. 30, 2018

(30) Foreign Application Priority Data

Feb. 28, 2017 (JP) ..... 2017-037739

(51) Int. Cl.

| | |
|---|---|
| ***G03G 5/147*** | (2006.01) |
| ***G03G 5/14*** | (2006.01) |
| ***G03G 5/16*** | (2006.01) |

(52) U.S. Cl.

CPC ..... *G03G 5/147* (2013.01); *G03G 5/144* (2013.01); *G03G 5/16* (2013.01)

(58) Field of Classification Search

CPC ..... G03G 5/14; G03G 5/142; G03G 5/144
See application file for complete search history.

(56) References Cited

U.S. PATENT DOCUMENTS

| | | | | |
|---|---|---|---|---|
| 4,579,801 | A | 4/1986 | Yashiki | |
| 2013/0344423 | A1* | 12/2013 | Fujii | G03G 5/047 430/56 |
| 2015/0212437 | A1 | 7/2015 | Shida et al. | |
| 2016/0231659 | A1 | 8/2016 | Tanaka et al. | |

FOREIGN PATENT DOCUMENTS

| | | | |
|---|---|---|---|
| EP | 0838729 | A1 | 4/1998 |
| EP | 2317393 | A1 | 5/2011 |
| EP | 2703890 | A1 | 3/2014 |
| JP | 2879084 | B2 | 4/1999 |

(Continued)

OTHER PUBLICATIONS

U.S. Appl. No. 15/904,055, filed Feb. 23, 2018.

*Primary Examiner* — Peter L Vajda
(74) *Attorney, Agent, or Firm* — Canon U.S.A., Inc. I.P. Division

(57) ABSTRACT

An electrophotographic photosensitive member includes a support member, an electroconductive layer, and a photosensitive layer in this order. The electroconductive layer contains a binder and particles. Each of the particles include a core made of a substance represented by general formula (1), and a coating layer coating the core and containing an electrically conductive material:

$$M^1M^2O_3 \quad (1)$$

wherein $M^1$ represents an element selected from the group consisting of Sr, Li, Na, K, and Ba, and $M^2$ represents an element selected from the group consisting of Ti, Nb, Ta, and Zr.

10 Claims, 3 Drawing Sheets

(56) References Cited

FOREIGN PATENT DOCUMENTS

| | | | |
|---|---|---|---|
| JP | H11109669 | A | 4/1999 |
| JP | 2005017470 | A | 1/2005 |
| JP | 2010030886 | A | 2/2010 |
| JP | 2012018405 | A | 1/2012 |
| JP | 2014160224 | A | 9/2014 |
| WO | 2011/027912 | A | 3/2011 |

* cited by examiner

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present disclosure relates to an electrophotographic photosensitive member, and a process cartridge and an electrophotographic apparatus each including the electrophotographic photosensitive member.

Description of the Related Art

Some of the electrophotographic photosensitive members (or electrophotographic photoreceptors) used in electrophotographic processes have an electroconductive layer containing metal oxide particles between a support member and a photosensitive layer. The electroconductive layer acts to relieve the increase of residual potential in image formation and keep dark and bright portion potentials from fluctuating and is beneficial in terms of potential stability in repeated use.

Electrophotographic photosensitive members including a layer containing a ferroelectric material are also known as disclosed in Japanese Patent Laid-Open No. 11-109669 and Japanese Patent No. 2879084. Japanese Patent Laid-Open No. 11-109669 discloses that an electrophotographic photosensitive member including a protective layer containing ferroelectric particles can be uniformly charged due to polarization. Japanese Paten No. 2879084 discloses an electrophotographic photosensitive member including an intermediate layer containing at least one compound selected from the group consisting of tantalates, titanates, and niobates.

SUMMARY OF THE INVENTION

According to an aspect of the present disclosure, there is provided an electrophotographic photosensitive member including a support member, an electroconductive layer, and a photosensitive layer in this order. The electroconductive layer contains a binder and particles. Each of the particles include a core containing a substance represented by general formula (1), and a coating layer coating the core and containing an electrically conductive material:

$$M^1M^2O_3 \quad (1)$$

wherein $M^1$ represents an element selected from the group consisting of Sr, Li, Na, K, and Ba, and $M^2$ represents an element selected from the group consisting of Ti, Nb, Ta, and Zr.

According to another aspect of the present disclosure, a process cartridge capable of removably mounted to an electrophotographic apparatus is provided. The process cartridge includes the above-described electrophotographic photosensitive member and at least one device selected from the group consisting of a charging device, a developing device, a transfer device, and a cleaning device. The electrophotographic photosensitive member and the at least one device are held in one body.

Also, an electrophotographic apparatus is provided. The apparatus includes the above-described electrophotographic photosensitive member, a charging device, an exposure device, a developing device, and a transfer device.

The electrophotographic photosensitive member according to the present disclosure can be uniformly charged and keep potential stable in repeated use.

Further features of the present invention will become apparent from the following description of exemplary embodiments with reference to the attached drawings.

DESCRIPTION OF THE EMBODIMENTS

Figure 1:
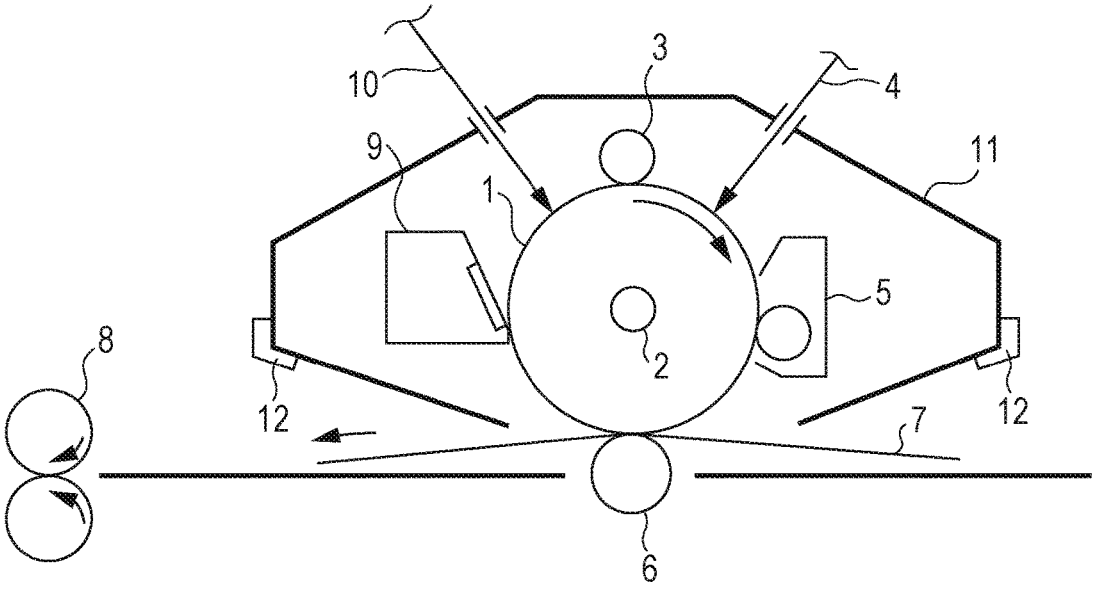
FIG. 1 is a schematic view of the structure of an electrophotographic apparatus provided with a process cartridge including an electrophotographic photosensitive member.

According to a study by the present inventors, the electrophotographic photosensitive member disclosed in Japanese Patent Laid-Open No. 11-109669 and Japanese Patent No. 2879084 cannot be uniformly charged nor keep potential stable in repeated use. The electrophotographic photosensitive member disclosed in Japanese Patent Laid-Open No. 11-109669 includes a protective layer containing ferroelectric particles that are generally insulative. These particles act as a carrier trap that restricts the flow of charge carriers in some cases, and accordingly, the electrophotographic photosensitive member does not satisfactorily keep potential stable when used repeatedly. If the thickness of the protective layer is reduced, the ferroelectric particles do not produce the intended effect of increasing dielectric relaxation, and, consequently, uniformity of charged potential is reduced. In the electrophotographic photosensitive member disclosed in Japanese Patent No. 2879084, the intermediate layer does not have a sufficient electrical conductivity, and the potential stability of the photosensitive member is insufficient in repeated use.

Accordingly, the present disclosure provides an electrophotographic photosensitive member that can be uniformly charged and keep potential stable in repeated use.

The subject matter of the present disclosure will be described in detail in exemplary embodiments.

In recent electrophotographic processes, power saving techniques have attracted an attention, and charging processes greatly effective in saving power have been studied. While alternating current/direct current (AC/DC) charging has been often used from the viewpoint of producing high-quality images, a charging technique of reducing the alternating current component (mainly using the direct current component) is being studied for saving power, for example.

The present inventors have found through their studies that when the known electrophotographic photosensitive member passes through the nip region with the charging roller for being charged, the discharge (downstream discharge) that occurs between the charging roller and the surface of the photosensitive member on the downstream side of the nip region becomes unstable, depending on the scheme for charging (for example, under a charging scheme mainly using the direct current component). It has been found that the unstable downstream discharge makes charged potential nonuniform, consequently causing problems with image quality, such as streaks formed in the resulting image. Such problems occur markedly in repeated use.

The present inventors have studied for solving such problems and found that it is effective in stabilizing downstream discharge to increase the attenuation of charged potential when the photosensitive member passes through the nip region. It has also been found that for this purpose, it is desirable that dielectric relaxation be increased by adding specific particles to the electroconductive layer. In particular, by using particles each including a core made of a ferroelectric material and coated with a coating layer containing an electrically conductive material in the electroconductive layer, dielectric relaxation can be increased, and electric conductivity can be improved. The mechanism of this can be explained as below.

The ferroelectric material used as the core material of the particles contained in the electroconductive layer increases the dielectric relaxation of the electrophotographic photosensitive member and promotes the attenuation of charged potential when the photosensitive member passes through the nip region. Also, the electrically conductive material in the coating layer of the particle enhances the electrical conductivity of the electroconductive layer, relieves the increase of residual potential in image formation, keeps dark and bright portion potentials from fluctuating, and keeps potential stable in repeated use. Furthermore, the ferroelectric material can be prevented from acting as a carrier trap.

Such synergistic interaction between components or members of the electrophotographic photosensitive member enables the photosensitive member to be uniformly charged and keep potential stable in repeated use.

Electrophotographic Photosensitive Member

The electrophotographic photosensitive member disclosed herein includes a support member, an electroconductive layer, and a photosensitive layer in this order.

The electrophotographic photosensitive member may be manufactured by applying each of the coating liquids prepared for forming the respective layers, which will be described later, in a desired order, and drying the coatings. Each coating liquid may be applied by dip coating, spray coating, ink jet coating, roll coating, die coating, blade coating, curtain coating, wire bar coating, ring coating, or any other method. In an embodiment, dip coating may be employed from the viewpoint of efficiency and productivity. The layers of the electrophotographic photosensitive member will now be described.

Support Member

The electrophotographic photosensitive member disclosed herein includes a support member. Beneficially, the support member is electrically conductive. The support member may be in the form of a cylinder, a belt, a sheet, or the like. A cylindrical support member is beneficial. The support member may be surface-treated by electrochemical treatment, such as anodization, or blasting, or cutting.

The support member may be made of a metal, a resin, or glass.

For a metal support member, the metal may be selected from among aluminum, iron, nickel, copper, gold, stainless steel, and alloys thereof. An aluminum support member is beneficial.

If the support member is made of a resin or glass, an electrically conductive material may be added into or applied over the support member to impart an electrical conductivity.

Electroconductive Layer

The electroconductive layer is disposed over the support member and contains a binder and particles each including a core made of a substance represented by general formula (1) and a coating layer coating the core and containing an electrically conductive material.

$$M^1M^2O_3 \quad (1)$$

In general formula (1), $M^1$ represents an element selected from the group consisting of Sr, Li, Na, K, and Ba, and $M^2$ represents an element selected from the group consisting of Ti, Nb, Ta, and Zr.

The substance forming the core is a ferroelectric material represented by general formula (1) and may be any one selected from among strontium titanate ($SrTiO_3$), barium titanate ($BaTiO_3$), and strontium niobate in view of stability in forming the coating layer and electrical conductivity. In some embodiments, $SrTiO_3$ or $BaTiO_3$ may be used.

The electrically conductive material contained in the coating layer of the particle may be selected from among metal oxides, metals, such as aluminum, palladium, iron, copper, and silver, composite materials surface-treated by electrolysis, spray coating, or mixed vibration, carbon black, and carbon black-based materials. Among these, carbon black and metal oxides are beneficial. In some embodiments, a metal oxide may be used. The metal oxide may be any one of tin oxide, zinc oxide, and titanium oxide.

The electrical conductivity of these metal oxides can be increased by reduction suitable for forming an oxygen-deficient structure or by doping with an appropriate dopant, thus helping improve potential stability of the photosensitive member. If tin oxide is used as the electrically conductive material, tin oxide may be doped with an element selected from the group consisting of niobium, tantalum, phosphorus, tungsten, and fluorine. If zinc oxide is used, zinc oxide may be doped with either aluminum or gallium. If tantalum oxide is used, titanium oxide may be doped with either niobium or tantalum.

The content of dopant added to the coating layer may be in the range of 0.5% by mass to 10.0% by mass relative to the total mass of the coating layer. If the dopant content is less than 0.5% by mass, the potential fluctuation at dark and bright portions may not be sufficiently reduced in some cases. In contrast, if the dopant content is higher than 10.0% by mass, leakage current may often occur in the electrophotographic photosensitive member. In an embodiment, the dopant content may be in the range of 1.0% by mass to 7.0% by mass relative to the total mass of the coating layer.

The core may be spherical, polyhedral, elliptical, flaky, needle-like, or the like. From the viewpoint of reducing image defects such as black spots, a spherical, polyhedral, or elliptical core is beneficial.

The particles may have an average primary particle size ($D_1$) in the range of 0.05 μm to 0.50 μm. Particles having an average primary particle size of 0.05 μm or more are unlikely to aggregate in the coating liquid prepared for forming the electroconductive layer (hereinafter may be referred to as electroconductive layer-forming coating liquid). Aggregates of the particles in the coating liquid reduce the stability of the coating liquid and cause the resulting electroconductive layer to crack in the surface thereof. If particles having an average primary particle size of 0.50 μm or less are used, the surface of the resulting electroconductive layer is unlikely to become rough. A rough surface of the electroconductive layer easily causes local charge carrier injection into the photosensitive layer. Consequently, black spots are likely to become noticeable in a white or blank area in the output image. More beneficially, the average primary particle size of the particles is in the range of 0.07 μm to 0.40 μm.

The average diameter of the core may be 1 time to 50 times, beneficially 5 times to 20 times, as large as the average thickness of the coating layer. Such particles are beneficial for further stabilizing potential in repeated use. In an embodiment, the average thickness of the coating layer may be 5 nm or more.

In an embodiment, the particles may be surface-treated with a silane coupling agent or the like.

In some embodiments, the particle content in the electroconductive layer may be in the range of 20% by volume to 50% by volume relative to the total volume of the electroconductive layer. When the particle content is less than 20% by volume, the distance between the particles increases and, accordingly, the volume resistivity of the electroconductive layer tends to increase. In contrast, when the particle content is more than 50% by volume, the distance between the particles decreases and, accordingly, the particles become likely to come into contact with each other. In this instance, particles in contact with each other locally reduce the volume resistivity of the electroconductive layer, tending to cause leakage in the electrophotographic photosensitive member. In some embodiments, the particle content in the electroconductive layer may be in the range of 30% by volume to 45% by volume relative to the total volume of the electroconductive layer.

In an embodiment, the electroconductive layer may further contain a different type of electrically conductive particles. The material of the further added electrically conductive particles may be a metal oxide, a metal, carbon black, or the like.

Examples of the metal oxide include zinc oxide, aluminum oxide, indium oxide, silicon oxide, zirconium oxide, tin oxide, titanium oxide, magnesium oxide, antimony oxide, and bismuth oxide. Examples of the metal include aluminum, nickel, iron, nichrome, copper, zinc, and silver.

If metal oxide particles are used as the further added electrically conductive particles, these particles may be surface-treated with a silane coupling agent or the like or doped with an element such as phosphorus or aluminum or oxide thereof.

The further added electrically conductive particles may each include a core and a coating layer coating the core. The core may be made of titanium oxide, barium sulfate, zinc oxide, or the like. The coating layer may be made of a metal oxide, such as tin oxide.

If metal oxide particles are used as the further added electrically conductive particles, the metal oxide particles may have a volume average particle size in the range of 1 nm to 500 nm, such as in the range of 3 nm to 400 nm.

The binder resin contained in the electroconductive layer may be of polyester resin, polycarbonate resin, polyvinyl acetal resin, acrylic resin, silicone resin, epoxy resin, melamine resin, polyurethane resin, phenol resin, or alkyd resin. In an embodiment, the binder may be of a thermosetting phenol resin or a thermosetting polyurethane resin. If a thermosetting resin is used as the binder, the binder added in the coating liquid for forming the electroconductive layer is in the form of a monomer and/or an oligomer of the thermosetting resin.

The electroconductive layer may further contain silicone oil, resin particles, or the like.

The average thickness of the electroconductive layer may be in the range of 0.5 μm to 50 μm, such as 1 μm to 40 μm or 5 μm to 35 μm.

In some embodiment, the volume resistivity of the electroconductive layer may be in the range of $1.0\times10^{7}$ Ω·cm to $5.0\times10^{12}$ Ω·cm. The electroconductive layer having a volume resistivity of $5.0\times10^{12}$ Ω·cm or less can help charge carriers to flow smoothly and suppress increase in residual resistance and potential fluctuation at dark and bright portions when an image is formed. Also, the electroconductive layer having a volume resistivity of $1.0\times10^{7}$ Ω·cm or more can suppress excessive flow of charge carriers in the electroconductive layer and leakage in the electrophotographic photosensitive member when the electrophotographic photosensitive member is charged. In an embodiment, the volume resistivity of the electroconductive layer may be in the range of $1.0\times10^{7}$ Ω·cm to $1.0\times10^{11}$ Ω·cm.

Figure 2:
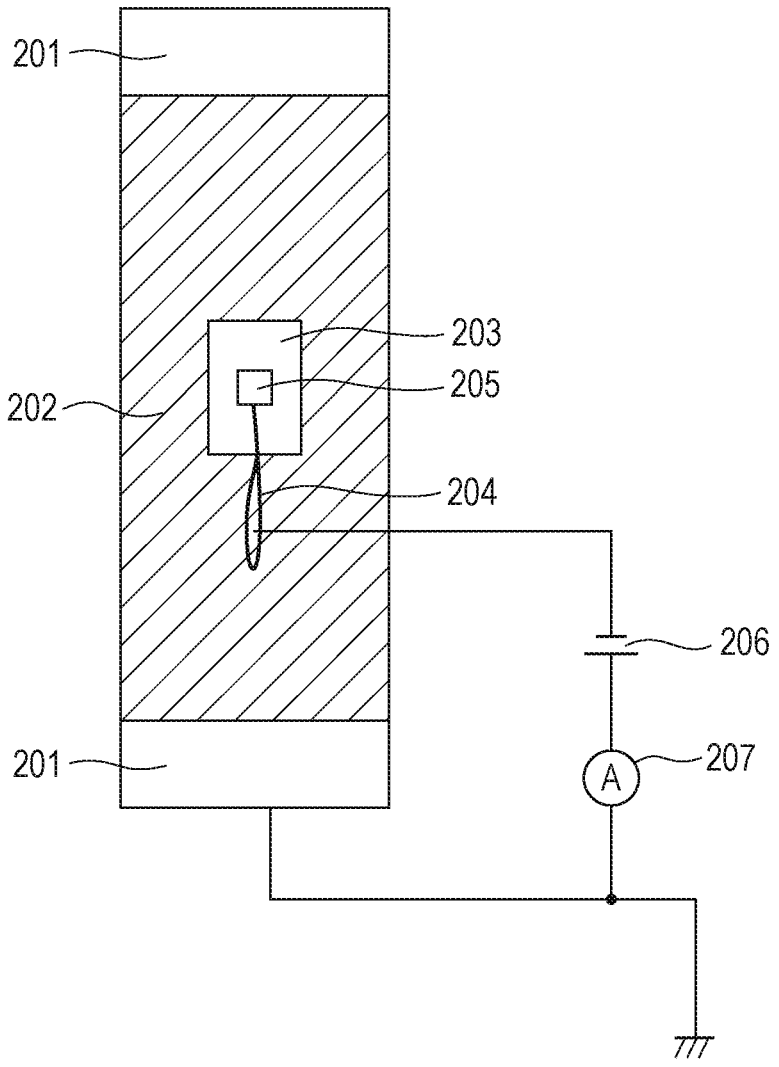
FIG. 2 is a top view of an electroconductive layer, illustrating a method for measuring the volume resistivity of the electroconductive layer.
Figure 3:
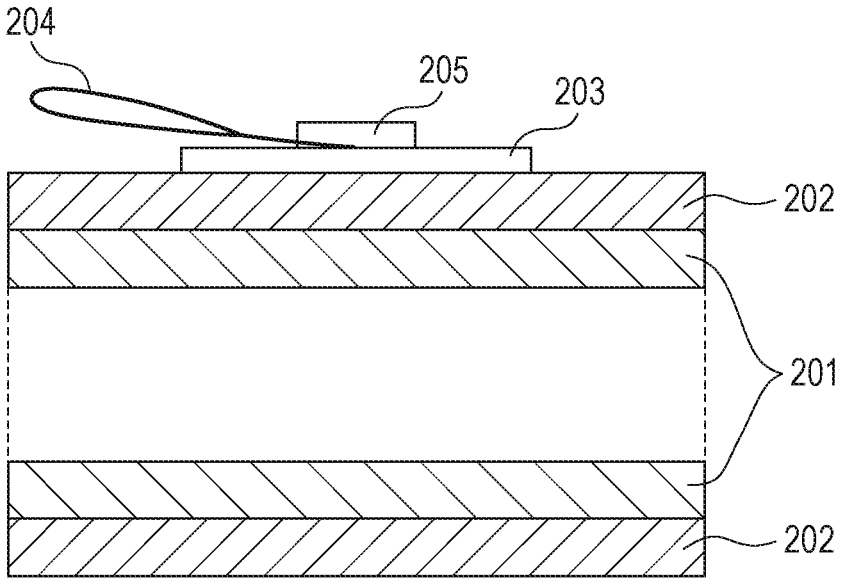
FIG. 3 is a sectional view of an electroconductive layer, illustrating a method for measuring the volume resistivity of the electroconductive layer.

A method for measuring the volume resistivity of the electrophotographic photosensitive member will be described with reference to FIGS. 2 and 3. FIG. 2 is a top view of an electroconductive layer, illustrating a method for measuring the volume resistivity of the electroconductive layer, and FIG. 3 is a sectional view of the electroconductive layer, illustrating the method.

The volume resistivity of the electroconductive layer is measured at normal temperature and normal humidity (temperature: 23° C., relative humidity: 50%). A copper tape 203 (product code No. 1181, manufactured by 3M) is stuck to the surface of the electroconductive layer 202. This tape is used as the front side electrode of the electroconductive layer 202. The support member 201 is used as the rear side electrode of the electroconductive layer 202. A power supply 206 from which a voltage is applied between the copper tape 203 and the support member 201 and a current measuring device 207 for measuring the current flowing between the copper tape 203 and the support member 201 are provided. For applying a voltage to the copper tape 203, a copper wire 204 is put on the copper tape 203 and fixed so as not to come off from the copper tape 203 by sticking another copper tape 205 onto the copper tape 203. A voltage is applied to the copper tape 203 through the copper wire 204.

The volume resistivity ρ (Ω·cm) of the electroconductive layer 202 is defined by the equation: $\rho=1/(I-I_0)\times S/d$, wherein $I_0$ represents the background current (A) when no current is applied between the copper tape 203 and the support member 201, I represents the current (A) when only a direct voltage (direct component) of −1 V is applied between the copper tape 203 and the support member 201, d represents the thickness (cm) of the electroconductive layer 202, and S represents the area ($cm^2$) of the front side electrode or copper tape 203 on the front side of the electroconductive layer 202.

The current measuring device 207 used for this measurement is beneficially capable of measuring very small current. In this measurement, a current as small as $1\times10^{-6}$ A or less in terms of absolute value is measured. Such a current measuring device may be, for example, pA meter 4140B manufactured by Hewlett-Packard. The volume resistivity of the electroconductive layer may be measured in a state where only the electroconductive layer is formed on the support member, or in a state where only the electroconductive layer is left after the overlying layers (including the photosensitive layer) have been removed from the electrophotographic photosensitive member. Either case obtains the same measurement value.

In an embodiment, a mass of the particles may have a volume resistivity (powder resistivity) in the range of $1.0\times10^{1}$ Ω·cm to $1.0\times10^{6}$ Ω·cm. When the powder resistivity is in this range, the electroconductive layer is likely to have a volume resistivity in the above-described range. In an embodiment, the powder resistivity of the particles may be in the range of $1.0\times10^2$ Ω·cm to $1.0\times10^5$ Ω·cm. The powder resistivity of the particles is measured at normal temperature and normal humidity (temperature: 23° C., relative humidity: 50%). Powder resistivity mentioned herein is the value measured with a resistivity meter Loresta GP manufactured by Mitsubishi Chemical Analytech. For this measurement, particles to be measured are pressed into a pellet at a pressure of 500 kg/cm$^2$, and the pellet is measured at an applied voltage of 100 V.

The electroconductive layer may be formed by applying an electroconductive layer-forming coating liquid containing the above-described ingredients and a solvent to form a coating film, followed by drying. The solvent of the coating liquid may be an alcohol-based solvent, a sulfoxide-based solvent, a ketone-based solvent, an ether-based solvent, an ester-based solvent, or an aromatic hydrocarbon. The metal oxide particles are dispersed in the coating liquid by using, for example, a paint shaker, a sand mill, a ball mill, or a high-speed liquid collision disperser. The thus prepared coating liquid may be filtered to remove unnecessary impurities.

Undercoat Layer

An undercoat layer may be disposed on the support member or the electroconductive layer. The undercoat layer enhances the adhesion between layers and blocks charge carrier injection.

The undercoat layer may contain a resin. The undercoat layer may be a cured film formed by polymerizing a composition containing a monomer having a polymerizable functional group.

Examples of the resin contained in the undercoat layer include polyester resin, polycarbonate resin, polyvinyl acetal resin, acrylic resin, epoxy resin, melamine resin, polyurethane resin, phenol resin, polyvinylphenol resin, alkyd resin, polyvinyl alcohol resin, polyethylene oxide resin, polypropylene oxide resin, polyamide resin, polyamide acid resin, polyimide resin, poly(amide-imide) resin, and cellulose resin.

Examples of the polymerizable functional group of the monomer include an isocyanate group, blocked isocyanate groups, a methylol group, alkylated methylol groups, and an epoxy group, metal alkoxide groups, a hydroxyl group, an amino group, a carboxy group, a thiol group, a carboxy anhydride group, and a carbon-carbon double bond.

The undercoat layer may further contain an electron transporting material, a metal oxide, a metal, or an electrically conductive polymer from the viewpoint of increasing the electrical properties thereof. In an embodiment, an electron transporting material or a metal oxide may be added.

Examples of the electron transporting material include quinone compounds, imide compounds, benzimidazole compounds, cyclopentadienylidene compounds, fluorenone compounds, xanthone compounds, benzophenone compounds, cyanovinyl compounds, halogenated aryl compounds, silole compounds, and boron-containing compounds. The undercoat layer may be a cured film formed by polymerizing an electron transporting material having a polymerizable functional group with any of the above-cited monomers having a polymerizable functional group.

Examples of the metal oxide added into the undercoat layer include indium tin oxide, tin oxide, indium oxide, titanium oxide, zinc oxide, aluminum oxide, and silicon dioxide. The metal added into the undercoat layer may be gold, silver, or aluminum.

The undercoat layer may further contain an additive.

The average thickness of the undercoat layer may be in the range of 0.1 μm to 50 μm, such as 0.2 μm to 40 μm or 0.3 μm to 30 μm.

The undercoat layer may be formed by applying an undercoat layer-forming coating liquid containing the above-described ingredients and a solvent to form a coating film, followed by drying and/or curing. The solvent of the undercoat layer-forming coating liquid may be an alcohol-based solvent, a ketone-based solvent, an ether-based solvent, an ester-based solvent, or an aromatic hydrocarbon.

Photosensitive Layer

The photosensitive layer may be: (1) a multilayer photosensitive layer; or (2) a single-layer photosensitive layer. (1) The multilayer photosensitive layer includes a charge generating layer containing a charge generating material, and a charge transport layer containing a charge transporting material. (2) The single-layer photosensitive layer is a photosensitive layer containing a charge generating material and a charge transporting material together.

(1) Multilayer Photosensitive Layer

The multilayer photosensitive layer includes a charge generating layer and a charge transport layer.

(1-1) Charge Generating Layer

The charge generating layer may contain a charge generating material and a resin.

Examples of the charge generating material include azo pigments, perylene pigments, polycyclic quinone pigments, indigo pigments, and phthalocyanine pigments. Among these, azo pigments and phthalocyanine pigments are beneficial. An oxytitanium phthalocyanine pigment, a chlorogallium phthalocyanine pigment, or a hydroxygallium phthalocyanine pigment may be used as the phthalocyanine pigment.

The charge generating material content in the charge generating layer may be in the range of 40% by mass to 85% by mass, such as in the range of 60% by mass to 80% by mass, relative to the total mass of the charge generating layer.

Examples of the resin contained in the charge generating layer include polyester resin, polycarbonate resin, polyvinyl acetal resin, polyvinyl butyral resin, acrylic resin, silicone resin, epoxy resin, melamine resin, polyurethane resin, phenol resin, polyvinyl alcohol resin, cellulose resin, polystyrene resin, polyvinyl acetate resin, and polyvinyl chloride resin. Among these, polyvinyl butyral resin is beneficial.

The charge generating layer may further contain an antioxidant, a UV absorbent, or any other additive. Examples of such an additive include hindered phenol compounds, hindered amine compounds, sulfur compounds, phosphorus compounds, and benzophenone compounds.

The thickness of the charge generating layer may be in the range of 0.1 μm to 1 μm, such as in the range of 0.15 μm to 0.4 μm.

The charge generating layer may be formed by applying a coating liquid containing the above-described ingredients and a solvent to form a coating film, followed by drying. The solvent of the coating liquid may be an alcohol-based solvent, a sulfoxide-based solvent, a ketone-based solvent, an ether-based solvent, an ester-based solvent, or an aromatic hydrocarbon.

(1-2) Charge Transport Layer

The charge transport layer may contain a charge transporting material and a resin.

Examples of the charge transporting material include polycyclic aromatic compounds, heterocyclic compounds, hydrazone compounds, styryl compounds, enamine compounds, benzidine compounds, triarylamine compounds, and resins having a group derived from these compounds. Triarylamine compounds and benzidine compounds are beneficial.

The charge transporting material content in the charge transport layer may be in the range of 25% by mass to 70% by mass, such as in the range of 30% by mass to 55% by mass, relative to the total mass of the charge transport layer.

The resin contained in the charge transport layer may be a polyester resin, a polycarbonate resin, an acrylic resin, or a polystyrene resin. In an embodiment, a polycarbonate resin or a polyester resin may be used. For example, a polyarylate resin may be used as the polyester resin.

The mass ratio of the charge transporting material to the resin may be in the range of 4:10 to 20:10, such as 5:10 to 12:10.

The charge transport layer may further contain an antioxidant, a UV absorbent, a plasticizer, a leveling agent, a lubricant, an abrasion resistance improver, and any other additive. More specifically, examples of such an additive include hindered phenol compounds, hindered amine compounds, sulfur compounds, phosphorus compounds, benzophenone compounds, siloxane-modified resin, silicone oil, fluororesin particles, polystyrene resin particles, polyethylene resin particles, silica particles, alumina particles, and boron nitride particles.

The average thickness of the charge transport layer may be in the range of 5 μm to 50 μm, such as 8 μm to 40 μm or 10 μm to 30 μm.

The charge transport layer may be formed by applying a charge transport layer-forming coating liquid containing the above-described ingredients and a solvent to form a coating film, followed by drying. The solvent of the charge transport layer-forming coating liquid may be an alcohol-based solvent, a ketone-based solvent, an ether-based solvent, an ester-based solvent, or an aromatic hydrocarbon. In an embodiment, an ether-based solvent or an aromatic hydrocarbon may be used as the solvent.

(2) Single-Layer Photosensitive Layer

The single-layer photosensitive layer may be formed by applying a coating liquid containing a charge generating material, a charge transporting material, a resin, and a solvent to form a coating film, followed by drying. The charge generating material, the charge transporting material, and the resin may be selected from among the same materials cited in "(1) Multilayer Photosensitive Layer".

Protective Layer

The photosensitive layer may be covered with a protective layer. The protective layer enhances durability.

The protective layer may contain electrically conductive particles and/or a charge transporting material and a resin.

The electrically conductive particles may be those of a metal oxide, such as titanium oxide, zinc oxide, tin oxide, or indium oxide.

Examples of the charge transporting material include polycyclic aromatic compounds, heterocyclic compounds, hydrazone compounds, styryl compounds, enamine compounds, benzidine compounds, triarylamine compounds, and resins having a group derived from these compounds. Triarylamine compounds and benzidine compounds are beneficial.

Examples of the resin contained in the protective layer include polyester resin, acrylic resin, phenoxy resin, polycarbonate resin, polystyrene resin, phenol resin, melamine resin, and epoxy resin. In an embodiment, a polycarbonate resin, a polyester resin, or an acrylic resin may be used.

The protective layer may be a cured film formed by polymerizing a composition containing a monomer having a polymerizable functional group. In this instance, a thermal polymerization reaction, a photopolymerization reaction, a radiation polymerization reaction, or the like may be conducted. The polymerizable functional group of the monomer may be an acryloyl group or a methacryloyl group. The monomer having a polymerizable functional group may have a charge transporting function.

The protective layer may further contain an antioxidant, a UV absorbent, a plasticizer, a leveling agent, a lubricant, an abrasion resistance improver, and any other additive. More specifically, examples of such an additive include hindered phenol compounds, hindered amine compounds, sulfur compounds, phosphorus compounds, benzophenone compounds, siloxane-modified resin, silicone oil, fluororesin particles, polystyrene resin particles, polyethylene resin particles, silica particles, alumina particles, and boron nitride particles.

The thickness of the protective layer may be in the range of 0.5 μm to 10 μm, such as in the range of 1 μm to 7 μm.

The protective layer may be formed by applying a coating liquid containing the above-described ingredients and a solvent to form a coating film, followed by drying and/or curing. The solvent of the coating liquid for the protective layer may be an alcohol-based solvent, a ketone-based solvent, an ether-based solvent, a sulfoxide-based solvent, an ester-based solvent, or an aromatic hydrocarbon.

Process Cartridge and Electrophotographic Apparatus

The process cartridge according to an embodiment of the present disclosure is removably mounted to an electrophotographic apparatus and includes the above-described electrophotographic photosensitive member and at least one device selected from the group consisting of a charging device, a developing device, a transfer device, and a cleaning device. The electrophotographic photosensitive member and these devices are held in one body.

Also, the electrophotographic apparatus according to an embodiment of the present disclosure includes the above-described electrophotographic photosensitive member, a charging device, an exposure device, a developing device, and a transfer device.

FIG. 1 is a schematic view of the structure of an electrophotographic apparatus provided with a process cartridge including an electrophotographic photosensitive member.

The electrophotographic photosensitive member designated by reference numeral 1 is cylindrical and is driven for rotation on an axis 2 in the direction indicated by an arrow at a predetermined peripheral speed. The surface of the electrophotographic photosensitive member 1 is charged to a predetermined positive potential or negative potential with a charging device 3. Although the charging device 3 is of roller type for roller charging in the embodiment shown in FIG. 1, the charging device may be a type for corona charging, proximity charging, injection charging, or the like in another embodiment. An electrostatic latent image corresponding to targeted image information is formed on the surface of the charged electrophotographic photosensitive member 1 by irradiation with exposure light 4 from an exposure device (not shown). The electrostatic latent image formed on the surface of the electrophotographic photosensitive member 1 is developed into a toner image with a toner contained in a developing device 5. The toner image on the surface of the electrophotographic photosensitive member 1 is transferred to a transfer medium 7 by a transfer device 6. The transfer medium 7 to which the toner image has been transferred is conveyed to a fixing device 8 for fixing the toner image, thus being ejected as an output image from the electrophotographic apparatus. The electrophotographic apparatus may include a cleaning device 9 for removing toner or the like remaining on the electrophotographic photosensitive member 1 after transfer. Alternatively, what is called a cleanerless system in which the developing device or the like acts to remove the toner or the like may be implemented without using a cleaning device. The electrophotographic apparatus may include a static elimination mechanism operable to remove static electricity from the surface of the electrophotographic photosensitive member 1 with pre-exposure light 10 from a pre-exposure device (not shown). Also, the electrophotographic apparatus may have a guide 12, such as a rail, that guides the removal or attachment of the process cartridge.

The electrophotographic photosensitive member of the present disclosure may be used in a laser beam printer, an LED printer, a copy machine, a facsimile, or a multifunctional machine having functions of those apparatuses.

EXAMPLES

The subject matter of the present disclosure will be further described in detail with reference to Examples and Comparative Examples. The subject matter is however not limited to the following Examples. In the following Examples, "part(s)" is on a mass basis unless otherwise specified.

Preparation of Particles

Carbon Black-Coated $SrTiO_3$ Particles: A-1

First, $SrTiO_3$ particles ST-1 were prepared as below. Metatitanic acid produced by a sulfate method was subjected to de-ironing and bleaching, and the resulting metatitanic acid was adjusted to a pH of 9.0 and desulfurized, followed by neutralization to pH 5.8, filtration, and rinsing with water. Water was added to the resulting cake to yield a slurry with a concentration of 1.85 mol/L in terms of $TiO_2$. Then, the slurry was peptized by adding hydrochloric acid to a pH of 1.0. Then, 0.625 mol (in terms of $TiO_2$) of the resulting colloid was placed in a 3 L reaction vessel. Furthermore, a strontium chloride aqueous solution (0.719 mol in terms of SrO) was added in a $SrO/TiO_2$ mole ratio of 1.15, followed by adjusting the $TiO_2$ concentration to 0.313 mol/L. Subsequently, the mixture was heated to 90° C. with stirring, and 296 mL of 5 mol/L sodium hydroxide aqueous solution was added to the mixture over a period of 18 hours, followed by stirring at 95° C. for 1 hour to complete the reaction. The resulting slurry was cooled to 50° C., and hydrochloric acid was added to the slurry until the pH of the slurry reached 5.0, followed by stirring for 1 hour. The resulting precipitate was subjected to decantation and rinsing and was then separated out by filtration. The separated precipitate was dried in air at 120° C. for 8 hours to yield $SrTiO_3$ particle powder ST-1. The average particle size of the powder measured by electron microscopy was 100 nm, and X-ray diffraction of the powder showed a strontium titanate single phase.

To 7.0 kg of the resulting $SrTiO_3$ particles ST-1 was added 140 g of methyl hydrogen polysiloxane with an edge runner working, and the materials were mixed and stirred at a line load of 588 N/cm (60 kg/cm) for 30 minutes. The stirring speed at this time was 22 rpm. Into the mixture was added 7.0 kg of carbon black particles (volume average particle size: 20 nm, volume resistivity: $1.0\times10^2$ Ω·cm, pH 8.0) over a period of 10 minutes with the edge runner working, and the materials were further mixed and stirred at a line load of 588 N/cm (60 kg/cm) for 60 minutes. Carbon black was thus attached to the surfaces of methyl hydrogen polysiloxane-coated $SrTiO_3$ particles. The resulting particles were dried at 80° C. for 60 minutes with a dryer to yield carbon black-coated $SrTiO_3$ particles A-1. The stirring speed at this time was 22 rpm. Thus obtained electrically conductive composite particles had a volume average particle size of 110 nm and a powder resistivity of $1.1\times10^2$ Ω·cm.

Carbon Black-Coated $BaTiO_3$ Particles: BT-1

Carbon black-coated $BaTiO_3$ Particles BT-1 were prepared in the same manner as carbon black-coated $SrTiO_3$ particles A-1 except that strontium titanate particles ST-1 were replaced with barium titanate particle powder (produced by KCM Corporation, average particle size: 150 nm).

Carbon Black-Coated $BaTiO_3$ Particles: BT-1X

Carbon black-coated $BaTiO_3$ Particles BT-1X were prepared in the same manner as carbon black-coated $SrTiO_3$ particles A-1 except that strontium titanate particles ST-1 were replaced with barium titanate particle powder (produced by KCM Corporation, average particle size: 300 nm).

Carbon Black-Coated $BaTiO_3$ Particles: BT-1Y

Carbon black-coated $BaTiO_3$ Particles BT-1Y were prepared in the same manner as carbon black-coated $SrTiO_3$ particles A-1 except that strontium titanate particles ST-1 were replaced with barium titanate particle powder (produced by KCM Corporation, average particle size: 400 nm).

Carbon Black-Coated $NaNbO_3$ Particles: SN-1

First, $NaNbO_3$ particles SN were prepared as below. In 150 mL of 0.10 mol/L HCl aqueous solution was dissolved 27.02 g of niobium chloride, and 0.10 mol/L HCl aqueous solution was added to a total volume of 200 mL to yield 0.50 mol/L $NbCl_5$ in 0.10 mol/L HCl aqueous solution. Subsequently, 6.0 mL of 0.50 mol/L $NbCl_5$ in HCl aqueous solution was slowly added into a 30 mL Teflon container charged with 6.0 mL of 18.0 mol/L NaOH aqueous solution at room temperature, and the resulting white suspension in the Teflon container was heated at 100° C. for 24 hours. The suspension was removed from the container to an autoclave including a Teflon inner cylinder and was then heated at 250° C. for 3 hours. The resulting suspension was subjected to centrifugation for collecting solids. The solids were ultrasonically dispersed in water, centrifugally settled, and dried to yield sodium niobate particles SN having an average particle size of 200 nm. Carbon black-coated $NaNbO_3$ particles SN-1 were prepared in the same manner as carbon black-coated $SrTiO_3$ particles A-1 except that sodium niobate particles SN were coated with carbon black.

Carbon Black-Coated $NaTaO_3$ Particles: NT-1

$NaTaO_3$ particles TA-1 were prepared as below. A high-temperature high-pressure batch type reactor including a Teflon inner cylinder (inner capacity: 50 $cm^3$) was charged with 0.0905 mol/kg $Ta_2O_5$ and 7 mol/kg sodium hydroxide. The reactor was heated to 145° C. in a heater, and the contents in the reactor were subjected to a hydrothermal reaction for 4 hours. After a predetermined time had elapsed, the reaction was stopped by cooling the reactor in a cold bath, and the reaction product was filtered through a simple filter and then dried at 100° C. for 30 minutes to yield $NaTaO_3$ particles TA-1 having an average particle size of 300 nm. Carbon black-coated $NaTaO_3$ particles NT-1 were prepared in the same manner as carbon black-coated $SrTiO_3$ particles A-1 except that $NaTaO_3$ particles TA-1 were coated with carbon black.

Carbon Black-Coated $BaZrO_3$ Particles: BZ-1

Carbon black-coated $BaZrO_3$ Particles BZ-1 were prepared in the same manner as carbon black-coated $SrTiO_3$ particles A-1 except that strontium titanate particles ST-1 were replaced with barium zirconate particle powder (produced by Nippon Chemical Industrial, average particle size: 300 nm).

Nb-Doped Titanium Oxide-Coated $SrTiO_3$ Particles: A-10

The above-prepared strontium titanate particle powder ST-1 was used as a core material, and 100 g of this particle powder was dispersed in water to prepare 1 L of aqueous suspension, followed by heating to 60° C. To this aqueous suspension were simultaneously dropped (parallelly added) a titanium-niobium acid solution, which was prepared by mixing a niobium solution prepared by dissolving 3 g of niobium pentachloride ($NbCl_5$) in 100 mL of 11.4 mol/L hydrochloric acid with 600 mL of titanium sulfate solution containing 33.7 g of Ti, and 10.7 mol/L sodium hydroxide solution over a period of 3 hours so that the suspension had a pH of 2 to 3. After dropping, the suspension was filtered, and the product was rinsed and dried at 110° C. for 8 hours. The dried product was heated at 800° C. in air for 1 hour to yield Nb-doped titanium oxide-coated $SrTiO_3$ particles A-10.

Ta-Doped Titanium Oxide-Coated $SrTiO_3$ Particles: A-11

Ta-doped titanium oxide-coated $SrTiO_3$ particles A-11 were prepared in the same manner as Nb-doped titanium oxide-coated $SrTiO_3$ particles A-10 except that niobium pentachloride was replaced with tantalum pentachloride.

Nb-Doped Titanium Oxide-Coated $BaTiO_3$ Particles: BT-10

Nb-doped titanium oxide-coated $BaTiO_3$ particles BT-10 were prepared in the same manner as Nb-doped titanium oxide-coated $SrTiO_3$ particles A-10 except that strontium titanate particles ST-1 were replaced with barium titanate particle powder (produced by KCM Corporation, average particle size: 150 nm).

Ta-Doped Titanium Oxide-Coated $BaTiO_3$ Particles: BT-11

Ta-doped titanium oxide-coated $BaTiO_3$ particles BT-11 were prepared in the same manner as Ta-doped titanium oxide-coated $SrTiO_3$ particles A-11 except that strontium titanate particles ST-1 were replaced with barium titanate particle powder (produced by KCM Corporation, average particle size: 150 nm).

Metal-Coated $SrTiO_3$ Particles: A-2, A-3

A 10 nm-thick copper coating film was formed over the surfaces of strontium titanate particles ST-1 by electroless plating to yield copper-coated strontium titanate particles A-2. Similarly, a 10 nm-thick silver coating film was formed over the surfaces of strontium titanate particles ST-1 by electroless plating to yield silver-coated strontium titanate particles A-3.

Tin Oxide-Coated $SrTiO_3$ Particles: A-4

Strontium titanate particle powder ST-1 (200 g) was dispersed in water to prepare 2 L of aqueous suspension, followed by heating to 70° C. Tin-acid solution A, which was prepared by dissolving 226.2 g of stannic chloride ($SnCl_4.5H_2O$) in 500 mL of 3 mol/L hydrochloric acid solution, and alkaline solution B, which was prepared by dissolving 5.2 g of sodium tungstate ($Na_2WO_4.2H_2O$) in 500 mL of 5 mol/L sodium hydroxide solution, were simultaneously dropped (parallelly added) over a period of 6 hours so that the suspension had a pH of 2 to 3. After dropping, the suspension was filtered, and the product was rinsed and dried at 110° C. for 8 hours. The dried product was heated at 650° C. in a nitrogen gas stream (1 L/min) for 1 hour to yield tin oxide-coated $SrTiO_3$ particles A-4.

Hetero-Element-Doped Tin Oxide-Coated $SrTiO_3$ Particles: A-5 to A-9

P-doped tin oxide-coated strontium titanate particles A-5, W-doped tin oxide-coated strontium titanate particles A-6, Nb-doped tin oxide-coated strontium titanate particles A-7, Ta-doped tin oxide-coated strontium titanate particles A-8, and F-doped tin oxide-coated strontium titanate particles A-9 were prepared in the same manner as tin oxide-coated $SrTiO_3$ particles A-4 except that P, W, Nb, Ta, and F were doped respectively when tin oxide coating was formed.

Tin Oxide-Coated $BaTiO_3$ Particles: BT-4

Tin oxide-coated barium titanate particles BT-4 were prepared in the same manner as tin oxide-coated $SrTiO_3$ particles A-4 except that strontium titanate particles ST-1 were replaced with barium titanate particle powder (produced by KCM Corporation, average particle size: 150 nm).

Hetero-Element-Doped Tin Oxide-Coated $BaTiO_3$ Particles: BT-5 to BT-9

P-doped tin oxide-coated barium titanate particles BT-5, W-doped tin oxide-coated barium titanate particles BT-6, Nb-doped tin oxide-coated barium titanate particles BT-7, Ta-doped tin oxide-coated barium titanate particles BT-8, and F-doped tin oxide-coated barium titanate particles BT-9 were prepared in the same manner as hetero-element-doped tin oxide-coated $SrTiO_3$ Particles A-5 to A-9, respectively, except that strontium titanate particles ST-1 were replaced with barium titanate particle powder (produced by KCM Corporation, average particle size: 150 nm).

Nb-Doped Titanium Oxide-Coated $BaTiO_3$ Particles with Increased Coating Amount: BT-10X, BT-10Y Nb-doped titanium oxide-coated $BaTiO_3$ particles BT-10X and BT-10Y were prepared in the same manner as Nb-doped titanium oxide-coated $BaTiO_3$ particles BT-10 except that the average particle size of the finished particles was 200 nm and 240 nm, respectively.

Preparation of Electrophotographic Photosensitive Members Preparation of Electroconductive Layer-Forming Coating Liquid Electroconductive Layer-Forming Coating Liquid 1

Polyol resins, 15 parts of a butyral resin BM-1 (produced by Sekisui Chemical) and 15 parts of a blocked isocyanate resin TPA-B80E (80% solution, produced by Asahi Kasei), were dissolved in a mixed solution of 45 parts of methyl ethyl ketone and 85 parts of 1-butanol. Into the resulting solution was added 75 parts of carbon black-coated strontium titanate particles A-1, and the particles were dispersed in the solution in a vertical sand mill with 120 parts of glass beads of 1.0 mm in average diameter at 25° C.±3° C. and a rotational speed of 1500 rpm (peripheral speed of 5.5 m/s) for 4 hours. The glass beads were removed from the resulting dispersion liquid by using a mesh. Then, 0.01 part of silicone oil SH28 PAINT ADDITIVE (produced by Dow Corning Toray) as a leveling agent and 3 parts of crosslinked polymethyl methacrylate (PMMA) particles Techpolymer SSX-102 (produced by Sekisui Plastics, average primary particle size: 2.5 μm) as a surface roughness agent were added into the dispersion liquid, and the mixture was stirred to yield electroconductive layer-forming coating liquid 1.

Electroconductive Layer-Forming Coating Liquids 2 to 27

Electroconductive layer-forming coating liquids 2 to 27 were prepared in the same manner as electroconductive layer-forming coating liquid 1 except that the particles were changed as shown in Table 1.

Electroconductive Layer-Forming Coating Liquid 28

In 35 parts of solvent 1-methoxy-2-propanol was dissolved 50 parts of binder that is phenol resin (phenol resin monomer/oligomer) Plyophen J-325 (produced by DIC, resin solids content: 60%, density after being cured: 1.3 g/cm$^2$). Into the resulting solution was added 75 parts of P-doped tin oxide-coated barium titanate particles BT-5, and the particles were dispersed in the solution in a vertical sand mill with 120 parts of glass beads of 1.0 mm in average diameter at a dispersion medium temperature of 23° C.±3° C. and a rotational speed of 1500 rpm (peripheral speed of 5.5 m/s) for 4 hours. The glass beads were removed from the resulting dispersion liquid by using a mesh. Then, 0.01 part of silicone oil SH28 PAINT ADDITIVE (produced by Dow Corning Toray) as a leveling agent and 10 parts of silicone resin particles Tospearl 120 (manufactured by Momentive Performance Materials, average particle size: 2 μm, density: 1.3 g/cm$^2$) as a surface roughness agent were added into the dispersion liquid, followed by stirring. The mixture was subjected to pressure filtration through a PTFE filter PF060 (manufactured by ADVANTEC) to yield electroconductive layer-forming coating liquid 28.

Electroconductive Layer-Forming Coating Liquid 29

Electroconductive layer-forming coating liquid 29 was prepared in the same manner as electroconductive layer-forming coating liquid 28 except that P-doped tin oxide-coated barium titanate particles BT-5 were replaced with Nb-doped titanium oxide-coated strontium titanate particles A-10.

Electroconductive Layer-Forming Coating Liquid 32

Electroconductive layer-forming coating liquid 32 was prepared in the same manner as electroconductive layer-forming coating liquid 28 except that P-doped tin oxide-coated barium titanate particles BT-5 were replaced with Nb-doped titanium oxide-coated $BaTiO_3$ particles BT-10.

Preparation of Electrophotographic Photosensitive Members Electrophotographic Photosensitive Member 1

An aluminum (aluminum alloy, JIS A3003) cylinder of 257 mm in length and 24 mm in diameter manufactured in a process including extrusion and drawing was used as a support member.

Electroconductive layer-forming coating liquid 1 was applied to the surface of the support member by dip coating at a temperature of 23° C. and a relative humidity of 50%. The resulting coating film was dried and cured by heating at 170° C. for 30 minutes to yield a 20 μm-thick electroconductive layer. The volume resistivity of the electroconductive layer was $5\times10^7$ Ω·cm.

Subsequently, 4.5 parts of N-methoxymethylated nylon resin Tresin EF-30T (produced by Nagase Chemtex) and 1.5 parts of a copolymerized nylon resin Amilan CM8000 (produced by Toray) were dissolved in a mixed solvent of 65 parts of methanol and 30 parts of n-butanol to yield an undercoat layer-forming coating liquid. The undercoat layer-forming coating liquid was applied to the surface of the electroconductive layer by dip coating. The resulting coating film was dried at 70° C. for 6 minutes to yield a 0.85 μm-thick undercoat layer.

Subsequently, 10 parts of a crystalline hydroxygallium phthalocyanine (charge generating material) whose CuKα X-ray diffraction spectrum has peaks at Bragg angles 2θ (±0.2°) of 7.5°, 9.9°, 16.3°, 18.6°, 25.1° and 28.3°, 5 parts of polyvinyl butyral S-LEC BX-1 (produced by Sekisui Chemical), and 250 parts of cyclohexanone were added into a sand mill containing glass beads of 0.8 mm in diameter. The contents in the sand mill were dispersed in each other for 3 hours. Into the resulting dispersion was added 250 parts of ethyl acetate to yield a coating liquid for forming a charge generating layer. This coating liquid was applied onto the undercoat layer by dip coating. The resulting coating film was dried at 100° C. for 10 minutes to yield a 0.15 μm-thick charge generating layer.

Then, a coating liquid for forming a charge transport layer was prepared by dissolving 6.0 parts of the amine compound (charge transporting material) represented by the following formula (CT-1), 2.0 parts of the amine compound (charge transporting material) represented by the following formula (CT-2), 10 parts of bisphenol Z polycarbonate 2400 (produced by Mitsubishi Engineering-Plastics), and 0.36 part of siloxane-modified polycarbonate having a repeating unit represented by the following formula (B-1) and a repeating unit represented by the following formula (B-2) with a mole ratio of (B-1):(B-2)=95:5 and having a terminal structure represented by the following formula (B-3) in a mixed solvent of 60 parts of o-xylene, 40 parts of dimethoxymethane, and 2.7 parts of methyl benzoate. The coating liquid for the charge transport layer was applied onto the surface of the charge generating layer by dip coating. The resulting coating film was dried at 125° C. for 30 minutes to yield a 10.0 μm-thick charge transport layer.

(CT-1)

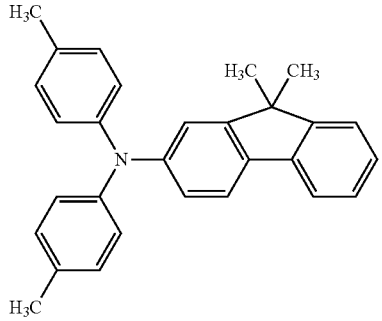

(CT-2)

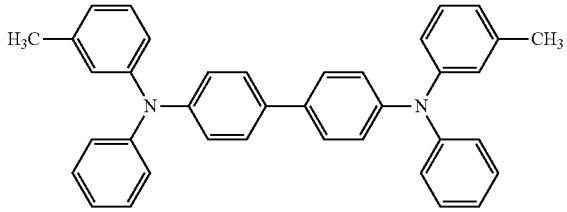

(B-1)

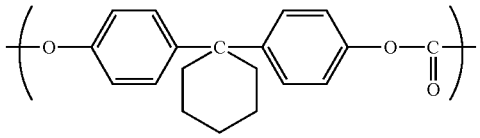

(B-2)

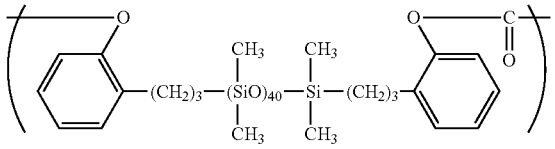

-continued (B-3)

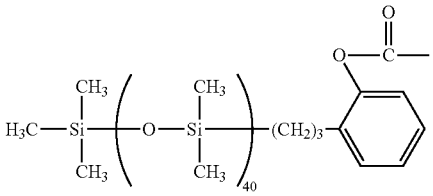

Thus, electrophotographic photosensitive member 1 having a charge transport layer as the surface layer was completed.

Electrophotographic Photosensitive Members 2 to 27

Electrophotographic photosensitive members 2 to 27, each having a charge transport layer as the surface layer, were prepared in the same manner as electrophotographic photosensitive member 1 except that the electroconductive layer-forming coating liquid 1 was replaced with electroconductive layer-forming coating liquids 2 to 27, respectively.

Electrophotographic Photosensitive Members 28, 29, and 32

Electrophotographic photosensitive members 28, 29, and 32, each having a charge transport layer as the surface layer, were prepared in the same manner as electrophotographic photosensitive member 1 except that the electroconductive layer-forming coating liquid 1 was replaced with electroconductive layer-forming coating liquids 28, 29, and 32, respectively, and that the drying temperature of the electroconductive layer was changed from 170° C. to 140° C.

Electrophotographic Photosensitive Member 30

Electrophotographic photosensitive member 30 having a charge transport layer as the surface layer was prepared in the same manner as electrophotographic photosensitive member 17 except that the undercoat layer was not formed on the electroconductive layer.

Electrophotographic Photosensitive Member 31

Electrophotographic photosensitive member 31 having a charge transport layer as the surface layer was prepared in the same manner as electrophotographic photosensitive member 22 except that the undercoat layer was not formed on the electroconductive layer.

Electrophotographic Photosensitive Member C1

Electrophotographic photosensitive member C1 was prepared in the same manner as electrophotographic photosensitive member 1 except that electroconductive layer-forming coating liquid C1 was prepared using strontium titanate particles ST-1 instead of using carbon black-coated strontium titanate particles A-1.

Electrophotographic Photosensitive Member C2

Electrophotographic photosensitive member C2 was prepared in the same manner as electrophotographic photosensitive member 1 except that electroconductive layer-forming coating liquid C2 was prepared using 66 parts of strontium titanate particles ST-1 and 9 parts of carbon black instead of using carbon black-coated strontium titanate particles A-1.

Electrophotographic Photosensitive Member C3

Electrophotographic photosensitive member C3 was prepared in the same manner as electrophotographic photosensitive member 1 except that electroconductive layer-forming coating liquid C3 was prepared using Ag-coated aluminum oxide particles (average particle size: 100 nm) instead of using carbon black-coated strontium titanate particles A-1.

Evaluation

The above-prepared electrophotographic photosensitive members 1 to 32 (corresponding to Examples 1 to 32, respectively) and electrophotographic photosensitive members C1 to C3 (corresponding to Comparative Examples 1 to 3, respectively) were examined for evaluation.

Potential Stability in Repeated Use

Each electrophotographic photosensitive member was mounted to a laser beam printer LBP 7200C manufactured by Canon and subjected to durability test using printing paper at a temperature of 23° C. and a relative humidity of 50%. In this durability test, character patterns were printed with a print coverage of 2% on 1000 letter sheets in an intermittent mode in which printed sheets were outputted one by one. The charged potential (dark portion potential) and the potential when exposed to light (bright portion potential) were measured before starting durability test and after 1000-sheet output. For the potential measurement, a white solid pattern sheet and a black solid pattern sheet were used. Charging and exposure were controlled so that the initial dark portion potential Vd and the initial bright portion potential Vl (at the beginning of durability test) could be −500 V and −150 V, respectively. The dark portion potential after 1000-sheet output is represented as Vd', and the bright portion potential after 1000-sheet output is represented as Vl'. The difference between the initial dark portion potential Vd and the dark portion potential Vd' after 1000-sheet output, ΔVd (=|Vd|−|Vd'|), and the difference between the initial bright portion potential Vl and the bright portion potential Vl' after 1000-sheet output, ΔVl (=|Vl'|−|Vl|), were obtained. The results are shown in Table 1.

Charged Potential Uniformity

Each sample was brought into a state where it was charged but not exposed to light (Vd=−500 V) at the beginning of durability test, and a cyan toner image was output with a developing bias of −400 V. The resulting image was observed for checking for streaks formed corresponding to the longitudinal direction of the charging roller and for measuring the length of the streaks, thus evaluating the uniformity of charged potential. The results were rated according to the following criteria. The results are shown in Table 1.

A: Streaks were not observed, showing high charged potential uniformity.

B: Streaks as small as less than 3 mm in length were observed, showing sufficient charged potential uniformity.

C: Streaks of 3 mm or more in length were observed, showing poor charged potential uniformity.

TABLE 1

Conditions for Producing Electrophotographic Photosensitive Member and Evaluation Results

| | Conditions | | | | | |
|---|---|---|---|---|---|---|
| | Particles | | Electroconductive layer | Result | | |
| Example No. | Type | Particle size (nm) | Volume resistivity [Ω · cm] | Potential stability ΔVd | Potential stability ΔVl | Charged potential uniformity |
| Example 1 | A-2 | 120 nm | $5 \times 10^{7}$ | 8 | 8 | B |
| Example 2 | A-3 | 120 nm | $1 \times 10^{7}$ | 8 | 8 | B |
| Example 3 | A-1 | 110 nm | $1 \times 10^{8}$ | 5 | 5 | B |
| Example 4 | A-4 | 120 nm | $5 \times 10^{9}$ | 5 | 8 | A |
| Example 5 | SN-1 | 210 nm | $2 \times 10^{8}$ | 6 | 10 | B |
| Example 6 | TA-1 | 310 nm | $4 \times 10^{8}$ | 6 | 10 | B |
| Example 7 | BZ-1 | 310 nm | $4 \times 10^{8}$ | 6 | 10 | B |
| Example 8 | BT-1 | 160 nm | $1 \times 10^{8}$ | 5 | 8 | B |
| Example 9 | BT-1X | 310 nm | $8 \times 10^{7}$ | 5 | 6 | B |
| Example 10 | BT-1Y | 410 nm | $5 \times 10^{7}$ | 7 | 7 | B |
| Example 11 | A-5 | 120 nm | $2 \times 10^{9}$ | 3 | 5 | A |
| Example 12 | A-6 | 120 nm | $3 \times 10^{9}$ | 3 | 5 | A |
| Example 13 | A-7 | 120 nm | $2 \times 10^{9}$ | 3 | 5 | A |
| Example 14 | A-8 | 120 nm | $4 \times 10^{9}$ | 3 | 5 | A |
| Example 15 | A-9 | 120 nm | $1 \times 10^{9}$ | 3 | 5 | A |
| Example 16 | BT-4 | 170 nm | $4 \times 10^{9}$ | 5 | 7 | A |
| Example 17 | BT-5 | 170 nm | $2 \times 10^{9}$ | 3 | 5 | A |
| Example 18 | BT-6 | 170 nm | $3 \times 10^{9}$ | 3 | 5 | A |
| Example 19 | BT-7 | 170 nm | $2 \times 10^{9}$ | 3 | 5 | A |
| Example 20 | BT-8 | 170 nm | $4 \times 10^{9}$ | 3 | 5 | A |
| Example 21 | BT-9 | 170 nm | $1 \times 10^{9}$ | 3 | 5 | A |
| Example 22 | A-10 | 120 nm | $9 \times 10^{9}$ | 3 | 6 | A |
| Example 23 | A-11 | 120 nm | $1 \times 10^{10}$ | 3 | 6 | A |
| Example 24 | BT-10 | 160 nm | $8 \times 10^{9}$ | 3 | 6 | A |
| Example 25 | BT-11 | 160 nm | $9 \times 10^{9}$ | 3 | 6 | A |
| Example 26 | BT-10X | 200 nm | $6 \times 10^{9}$ | 2 | 5 | A |
| Example 27 | BT-10Y | 240 nm | $4 \times 10^{9}$ | 2 | 5 | A |
| Example 28 | BT-5 | 170 nm | $3 \times 10^{10}$ | 3 | 5 | A |
| Example 29 | A-10 | 120 nm | $1 \times 10^{11}$ | 3 | 6 | A |
| Example 30 | BT-5 | 170 nm | $3 \times 10^{10}$ | 3 | 5 | A |
| Example 31 | A-10 | 120 nm | $1 \times 10^{11}$ | 3 | 6 | A |
| Example 32 | BT-10 | 160 nm | $1 \times 10^{11}$ | 3 | 6 | A |
| Comparative Example 1 | ST-1 | 100 nm | $1 \times 10^{14}$ | 50 | 60 | B |
| Comparative Example 2 | ST-1 and carbon black | 100 nm | $1 \times 10^{13}$ | 10 | 30 | B |
| Comparative Example 3 | Ag-coated Al particles | 100 nm | $4 \times 10^{7}$ | 5 | 5 | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-037739 filed Feb. 28, 2017, which is hereby incorporated by reference herein in its entirety.

What is claimed is:

1. An electrophotographic photosensitive member comprising:

a support member; an electroconductive layer; and a photosensitive layer in this order, wherein the electroconductive layer contains a binder and particles, the particles each including a core made of a substance represented by general formula (1), and a coating layer coating the core and containing an electrically conductive material:

$$M^1M^2O_3 \quad (1)$$

wherein $M^1$ represents an element selected from the group consisting of Sr, Li, Na, K, and Ba, and $M^2$ represents an element selected from the group consisting of Ti, Nb, Ta, and Zr.

2. The electrophotographic photosensitive member according to claim 1, wherein the electrically conductive material is a metal oxide.

3. The electrophotographic photosensitive member according to claim 2, wherein the metal oxide is one selected from the group consisting of tin oxide, zinc oxide, and titanium oxide.

4. The electrophotographic photosensitive member according to claim 3, wherein the tin oxide is doped with an element selected from the group consisting of niobium, tantalum, phosphorus, tungsten, and fluorine.

5. The electrophotographic photosensitive member according to claim 3, wherein the zinc oxide is doped with one of aluminum and gallium.

6. The electrophotographic photosensitive member according to claim 3, wherein the titanium oxide is doped with one of niobium and tantalum.

7. The electrophotographic photosensitive member according to claim 1, wherein the core is made of a substance selected from the group consisting of $SrTiO_3$, $BaTiO_3$, and $NaNbO_3$.

8. The electrophotographic photosensitive member according to claim 1, wherein the electroconductive layer has a volume resistivity in the range of $1.0\times10^7$ Ω·cm to $1.0\times10^{11}$ Ω·cm.

9. A process cartridge capable of being removably attached to an electrophotographic apparatus, the process cartridge comprising:

an electrophotographic photosensitive member; and at least one device selected from the group consisting of a charging device, a developing device, a transfer device, and a cleaning device, the at least one device being held together with the electrophotographic photosensitive member in one body, wherein the electrophotographic photosensitive member includes a support member, an electroconductive layer, and a photosensitive layer in this order, the electroconductive layer containing a binder and particles, the particles each including a core made of a substance represented by general formula (1), and a coating layer coating the core and containing an electrically conductive material:

$$M^1M^2O_3 \quad (1)$$

wherein $M^1$ represents an element selected from the group consisting of Sr, Li, Na, K, and Ba, and $M^2$ represents an element selected from the group consisting of Ti, Nb, Ta, and Zr.

10. An electrophotographic apparatus comprising:

an electrophotographic photosensitive member;

a charging device;

an exposure device;

a developing device; and a transfer device, wherein the electrophotographic photosensitive member includes a support member, an electroconductive layer, and a photosensitive layer in this order, the electroconductive layer containing a binder and particles, the particles each including a core made of a substance represented by general formula (1), and a coating layer coating the core and containing an electrically conductive material:

$$M^1M^2O_3 \quad (1)$$

wherein $M^1$ represents an element selected from the group consisting of Sr, Li, Na, K, and Ba, and $M^2$ represents an element selected from the group consisting of Ti, Nb, Ta, and Zr.

* * * * *